US010410812B2

(12) United States Patent
Zhu et al.

(10) Patent No.: US 10,410,812 B2
(45) Date of Patent: Sep. 10, 2019

(54) ELECTRIC POWER DISTRIBUTION SWITCH

(71) Applicant: S&C Electric Company, Chicago, IL (US)

(72) Inventors: Xin G. Zhu, Chicago, IL (US); Thomas Fanta, Lake Zurich, IL (US)

(73) Assignee: S&C Electric Company, Chicago, IL (US)

( * ) Notice: Subject to any disclaimer, the term of this patent is extended or adjusted under 35 U.S.C. 154(b) by 0 days.

(21) Appl. No.: 14/607,765

(22) Filed: Jan. 28, 2015

(65) Prior Publication Data

US 2015/0155119 A1 Jun. 4, 2015

Related U.S. Application Data

(60) Division of application No. 13/647,937, filed on Oct. 9, 2012, now abandoned, which is a continuation of application No. PCT/US2011/032921, filed on Apr. 18, 2011.

(60) Provisional application No. 61/325,360, filed on Apr. 18, 2010.

(51) Int. Cl.

| | |
|---|---|
| ***H01H 31/02*** | (2006.01) |
| ***H01H 31/28*** | (2006.01) |
| ***H01H 31/30*** | (2006.01) |
| *H01H 1/42* | (2006.01) |

(52) U.S. Cl.

CPC ..... *H01H 31/026* (2013.01); *H01H 31/023* (2013.01); *H01H 31/28* (2013.01); *H01H 31/30* (2013.01); *H01H 1/42* (2013.01)

(58) Field of Classification Search

CPC .... H01H 13/026; H01H 13/023; H01H 13/30; H01H 31/28; H01H 1/42

USPC ..... 200/48 R, 48 KB, 48 P, 48 A, 48 V, 200/48 CB, 244, 254, 279; 218/20, 21, 218/16, 17

See application file for complete search history.

(56) References Cited

U.S. PATENT DOCUMENTS

| | | | | |
|---|---|---|---|---|
| 3,627,939 A * | 12/1971 | Myers | H01H 1/38 | 200/48 SB |
| 3,855,433 A * | 12/1974 | Bernatt | H01H 31/32 | 200/48 R |
| 5,483,030 A * | 1/1996 | Bridges | H01H 33/42 | 200/48 KB |
| 6,809,905 B2 * | 10/2004 | Kilmer | G11B 5/4846 | 360/264.2 |
| 7,091,431 B1 * | 8/2006 | Arcand | H01H 1/42 | 200/48 R |
| 2008/0217154 A1 * | 9/2008 | Stenzel | H01H 31/28 | 200/48 R |

* cited by examiner

*Primary Examiner* — Harshad C Patel

(57) ABSTRACT

An electric power distribution switch incorporates a stress-relieving connection structure, a closing guiding structure, a weather shield structure and a contact structure.

7 Claims, 7 Drawing Sheets

ELECTRIC POWER DISTRIBUTION SWITCH

CROSS-REFERENCE TO RELATED APPLICATIONS

This is a divisional application of U.S. application Ser. No. 13/647,937 filed Oct. 9, 2012, which application is a continuation of PCT/US2011/032921 filed Apr. 18, 2011, which application claims benefit of U.S. Provisional Patent Application No. 61/325,360 filed Apr. 18, 2010 for all purposes and the disclosure of which is hereby expressly incorporated herein by reference.

TECHNICAL FIELD

This patent relates to commodity distribution and in particular to a switch for electric power distribution applications.

Distribution switches can be configured to provide no-external-arc circuit interruption for overhead distribution feeders. Such switches are well suited for line switching (Including sectionalizing and feeder switching), transformer switching, cable switching and the like. Often configured to be gang-operated, i.e., a single operating mechanism switches all of the distribution phases. Such gang-operated switches may provide may provide a ground level manual operating handle or a vandal-resistant hookstick operating handle. The switches include an interrupter providing simultaneous, close three-pole interphase interrupting.

While many configuration of distribution switches, such as the Omni-Rupter® Switch available from S&C Electric Company of Chicago, Ill., United States of America; continuous improvement in the structure and function of such switches ensures enhanced operating capability and reliability.

DETAILED DESCRIPTION

Figure 1:
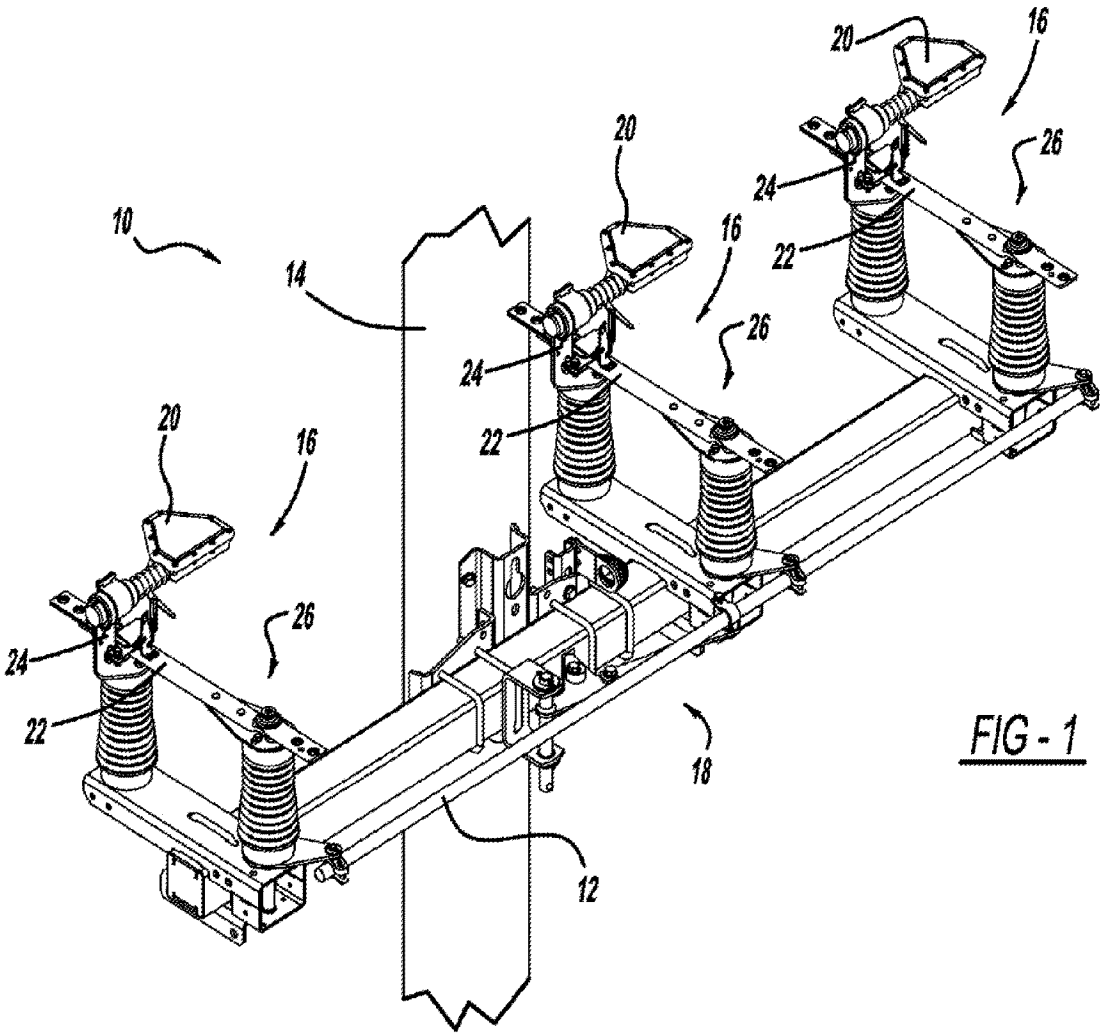
FIG. 1 is perspective view of a distribution switch in accordance with the prior art.

FIG. 1 depicts a distribution switch 10 including a mounting member 12 so that the switch 10 may be mounted to a utility pole 14. Many alternative mounting configurations are possible. The switch 10 includes a plurality of phase interrupting and switching assemblies 16, and in the application for switch 10 three assemblies 16 corresponding to a three-phase distribution system. Each of the assemblies 16 is coupled to an operator 18 for simultaneous operation.

Each assembly 16 includes a current interrupter 20 such as a vacuum interrupter, a blade assembly 22, a blade contact assembly 24, and terminal connections 26.

Switches, like the switch 10 incorporate pivoting hinges to allow rotation of the blade assembly 22 during opening and closing of the switch. The terminal pad for landing the high voltage conductor of the distribution system may be incorporated in the hinge design. A typical configuration, before the structures of the instant invention, uses a single-axis rotating contact. This configurations is sensitive to the alignment of the conductor to the hinge terminal pad, namely, the conductor needs to be well aligned with the hinge terminal pad to prevent uneven loading of the hinge structure. With large size conductors it is difficult to conform and land the conductors on the hinge terminal pad without applying an off-set or torsional load to the hinge terminal pad. Offset or torsional loading of the hinge assembly can cause uneven contact forces or misalignment of the blade and jaw contracts of the switch during closing.

Figure 2:
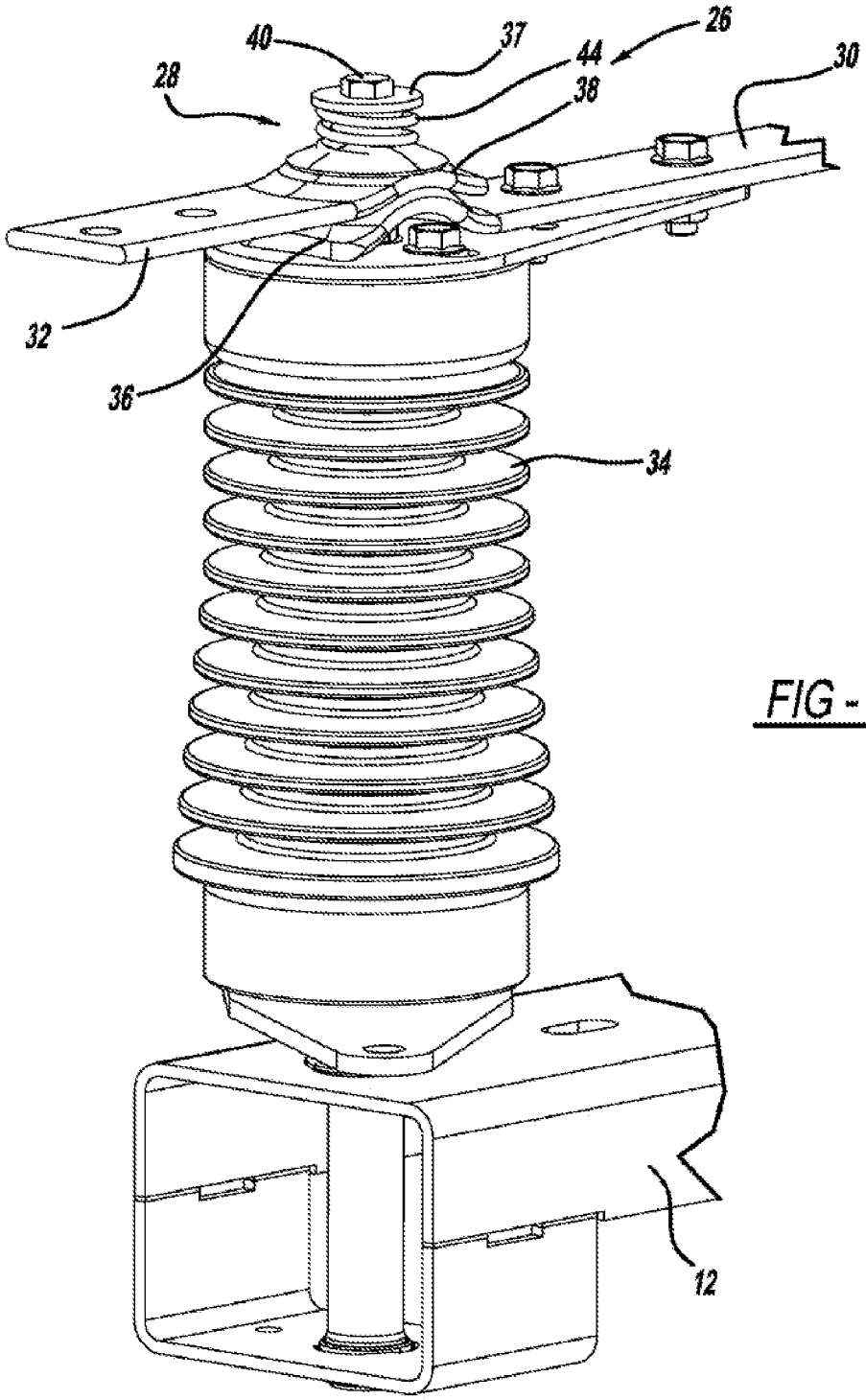
FIG. 2 is a perspective view of terminal connection to a switch of a distribution switch.
Figure 3:
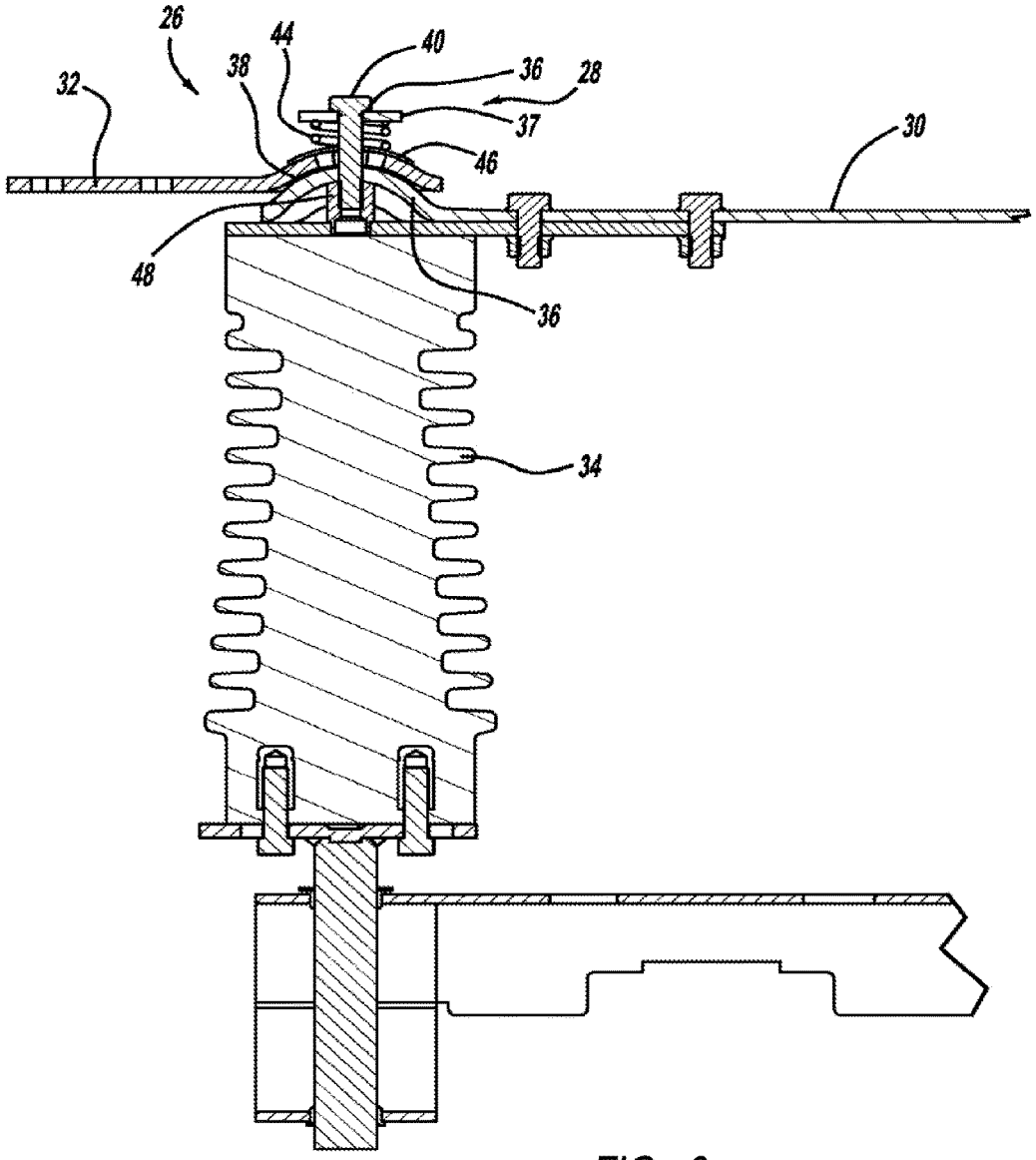
FIG. 3 is a side view of the terminal connection of FIG. 2.

Referring to FIGS. 2 and 3, a terminal connection 26 is shown and includes a spherical hinge joint 28. The hinge joint 28 incorporates a blade terminal portion 30 and a hinge terminal portion 32 secured to an insulator 34. The blade terminal portion 30 is formed with a semi-spherical or convex surface portion 36. The hinge terminal portion 32 mounts on the blade terminal portion 30 and is formed with a semi-spherical or convex surface portion 38 corresponding to the convex surface portion 36 such that the interaction of the portions 36 and 38 act as a bearing. Additionally, the portion 38 may be formed with buttons, bumps or other protuberances to contact the portion 36 to ensure good electrical contact.

Both the blade 30 and the hinge 32 are formed with an aperture (not depicted) through which a post 40 extends, the post 40 being secured to the insulator 34. The post has a groove end 36 on which a fastener clip 37 secures the blade 28 and the hinge 30 to the insulator along with washers and spacers, as necessary. A spring 44 is disposed between the washers 46 to provide damping force to ensure the hinge portion 32 always remains in contact with the blade portion 30. Other securing and biasing techniques including staking, upsetting and the like may be used. Additionally, the aperture formed in the hinge portion 32 may be formed as slot 48 to allow it to rotate 360 degrees about the post 40 and additionally rotate upward (FIG. 2) and downward (FIG. 3) a predetermined amount, for example between about 10 and 15 degrees, for example 13 degrees, and to twist about its longitudinal axis between about +/−5 degrees, for example 3 degrees.

The offset, twist and rotation of the hinge portion 32 are made without affecting contact force with the blade 30 or straining the terminal connection 26.

Figure 4:
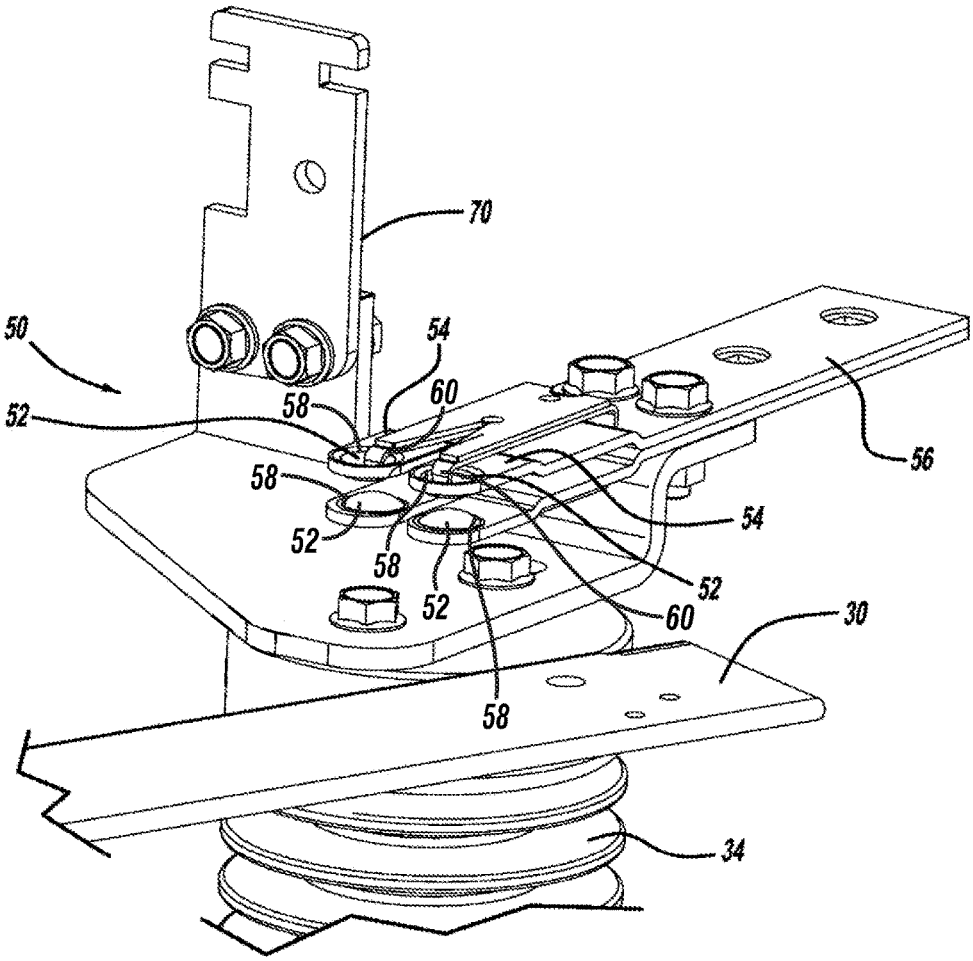
FIG. 4 is a top perspective view of a contact assembly of a distribution switch.
Figure 5:
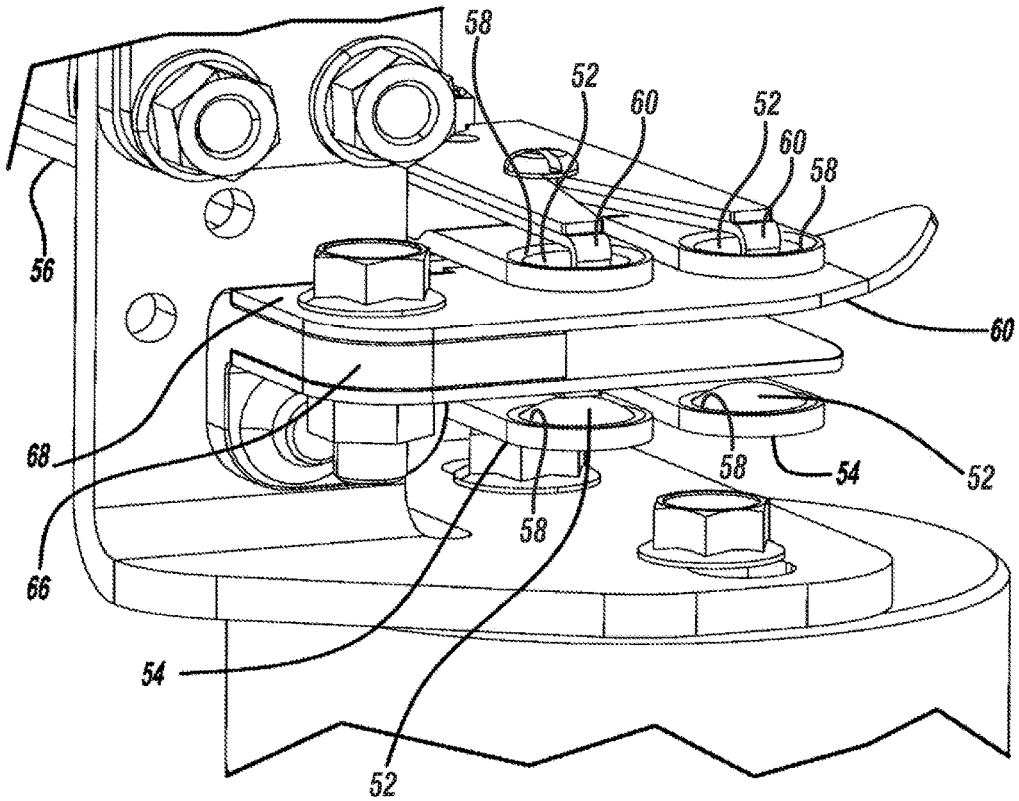
FIG. 5 is an enlarged view of a contact assembly similar to that shown in FIG. 4.
Figure 6:
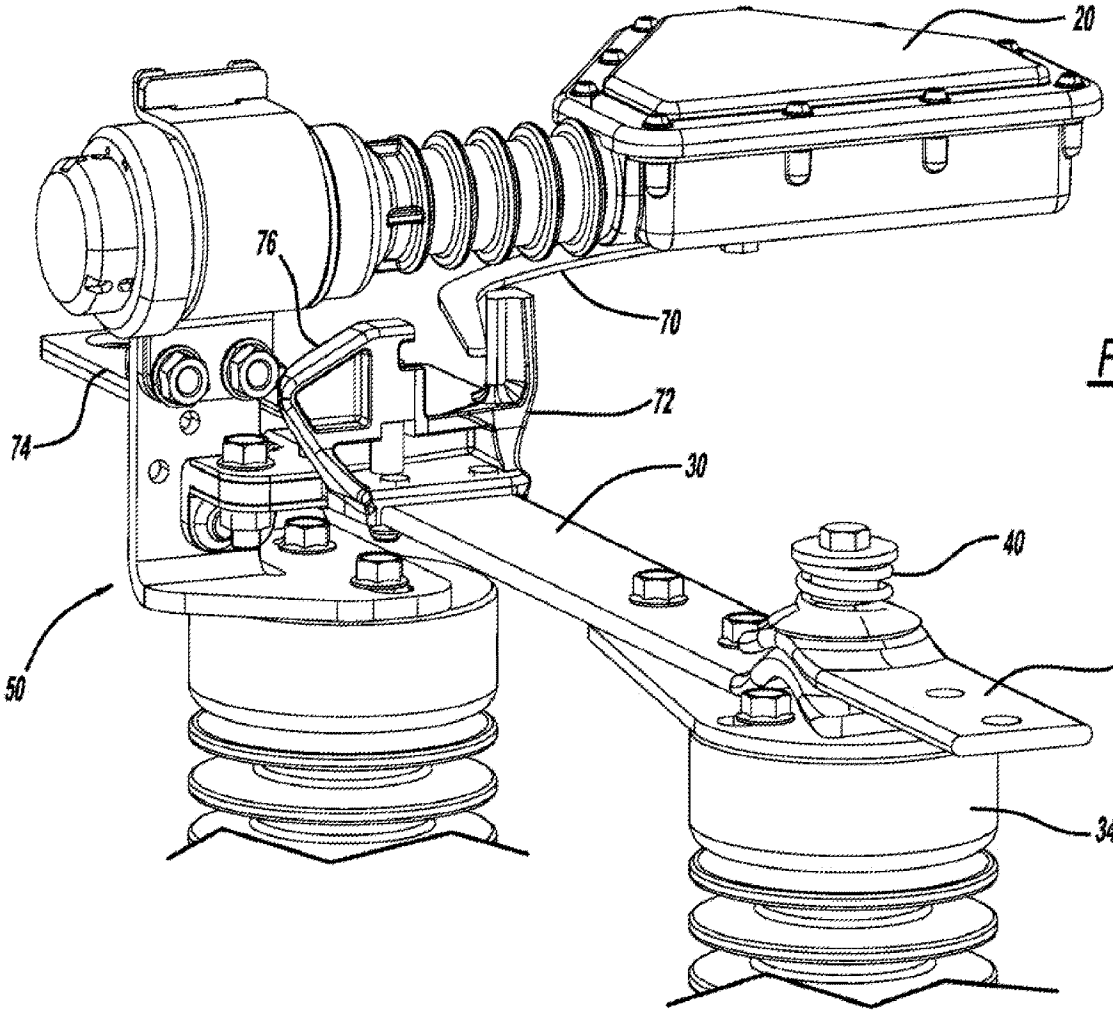
FIG. 6 is a perspective view of a blade assembly of a destruction switch.
Figure 7:
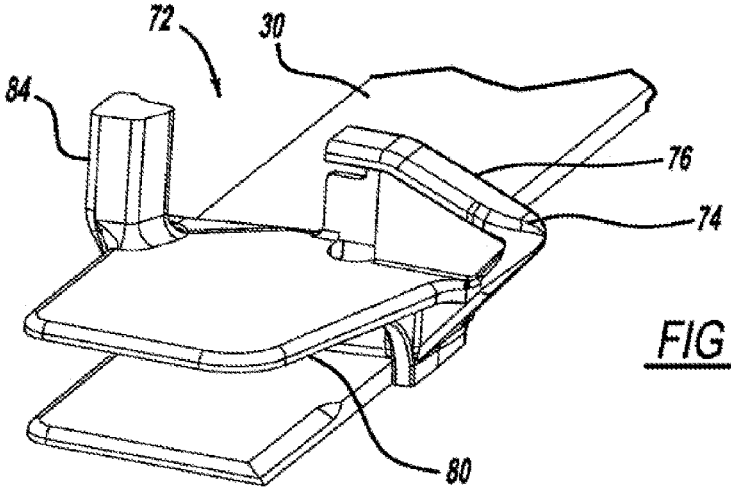
FIG. 7 is a perspective view of a blade cam of the blade assembly of FIG. 6.
Figure 8:
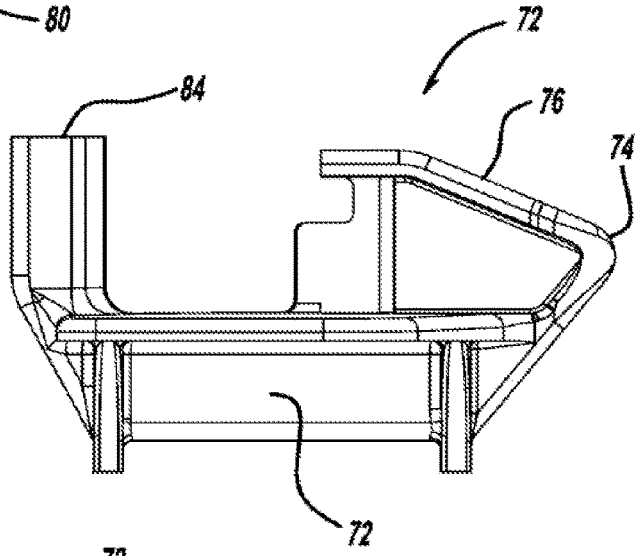
FIG. 8 is a side view of the blade cam of FIG. 7.
Figure 9:
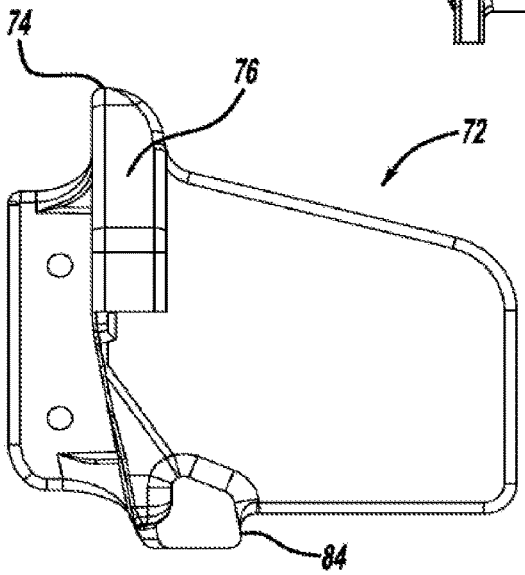
FIG. 9 is a top view of the blade cam of FIG. 7.

Alignment and loading of the terminal connection 26 by the conductor can also affect blade and contact engagement resulting in uneven or excessive contact forces and corresponding contact wear. Unusual contact forces and contact wear can reduce the current carrying capability of the terminal connection. Referring to FIGS. 4-5, a contact assembly 50 is of the jaw contact type and includes a plurality (two depicted) jaw contact buttons 52 of the corresponding jaw contact fingers 54 of a jaw contact 56 that float in apertures 58 formed in guide fingers 60. The floating contact buttons arrangement allows evening of contact forces of the upper and lower jaw contacts.

The width of the guide fingers 60 and deflection of the jaw contact fingers 54 is such that force to align the jaw contracts 56 and generally spread the contact force over a large surface area of the blade 30. The guide fingers 60 also provide a sacrificial arcing surface while closing the blade into high current faults or similar energized situations. The leading tips of the guide fingers take the pre-strike arc erosion during fault closing while leaving the jaw contact 56 surfaces undamaged. Additionally, the guide fingers 60 support the jaw contacts 56 from collapsing due to a biasing force of the contact spring 64 and from electromagnetic forces during high current situations, thus allowing elimination from the assembly of a spacer previously used to maintain the spacing of the jaw contacts 56.

During closing of the blade 30 the guide fingers 60 center the blade 30 as it enters into the contact assembly 50. If the blade 30 is misaligned, the guide fingers 60 gradually center the blade 30 as it enters the contact assembly 50. The guide fingers are spaced a predetermined amount wider than the thickness of the blade 30, for example approximately 0.030 inch (0.762 millimeters). The guide fingers 60 further include a bumper 66 and guide block 68 that are adjustable on the mounting block 70 in order to align and center the guide fingers on the jaw contacts. Once the guide fingers 60 are aligned, the jaw contact buttons 52 protrude from the apertures 58, for example approximately 0.050 inch (1.25 millimeter) to make contact with the blade 30.

The switch 10 incorporates for each phase a shunt interrupter 20. The interrupter 20 is operated by engagement of a shunt-operating arm 70 with a cam 72 secured to the blade 30. It is important for proper operation of the shunt interrupter 16 that the arm 70 properly latch with the cam 72 because failing to do so can result in the contacts in the interrupter 16 not opening correctly and the current not being interrupted. It is possible even that an external arc can result and a flashover of the switch 16.

Referring to FIGS. 6-9, the cam 72 is formed with an integral closing feature 74 to ensure the operating arm 70 is moved to the fully closed and latched position upon closing of the associated switch 16. An additional feature 76, a multi-angled cam surface that allows resetting of the operating arm 70. The surface 76 forces the flexible arm 70 over the conductive pin 78 during closing of the switch 16. There is also a protruded shelf 80 on the cam 72 that acts as an ice shield to prevent formation of ice on the end of the blade 30. Significant ice formation on the tip of the blade 30 conductive material can prevent the switch 16 from fully closing into the contact assembly 50. A non-conductive material is chosen for the cam 72 that allows it and the ice shield 80 to act as a dielectric barrier between the arm 70 and the guide fingers 60 of the contact assembly 50

The cam 72 is mounted to the blade 30 of the associated switch 16. The conductive pin 78 that connects to the blade 30 is formed integral with the cam 72, for example by in situ molding. The pin 78 actuates the operating arm 70 of the interrupter 20 during the opening sequence of the switch 16. One the interrupter 20 trips open, the pin 78 continues to keep the interrupter 20 open until the arm 70 loses contact with the pin 78. The arm 70 then returns to its closed position by action of an internal spring (not depicted). During closing of the switch 16, the surface 76 raises the arm 70 over the pin 78. The integrated closing stop 84 on the cam 72 ensures the interrupter 20 is closed, reset and ready for the next operation.

While the invention is described in terms of several embodiments of switches, it will be appreciated that the invention is not limited to such structures. The inventive concepts may be employed in connection with any number of devices and methods of making and using such devices.

Additionally, while the structures and methods of the present disclosure are susceptible to various modifications and alternative forms, certain embodiments are shown by way of example in the drawings and the herein described embodiments. It will be understood, however, that this disclosure is not intended to limit the invention to the particular forms described, but to the contrary, the invention is intended to cover all modifications, alternatives, and equivalents defined by the appended claims.

It should also be understood that, unless a term is expressly defined in this patent using the sentence "As used herein, the term '_' is hereby defined to mean . . . " or a similar sentence, there is no intent to limit the meaning of that term, either expressly or by implication, beyond its plain or ordinary meaning, and such term should not be interpreted to be limited in scope based on any statement made in any section of this patent (other than the language of the claims). To the extent that any term recited in the claims at the end of this patent is referred to in this patent in a manner consistent with a single meaning, that is done for sake of clarity only so as to not confuse the reader, and it is not intended that such claim term by limited, by implication or otherwise, to that single meaning. Unless a claim element is defined by reciting the word "means" and a function without the recital of any structure, it is not intended that the scope of any claim element be interpreted based on the application of 35 U.S.C. § 112, sixth paragraph.

The invention claimed is:

1. A contact assembly for an electric power switch comprising a jaw contact type including a jaw contact button disposed to float within an aperture formed in a corresponding jaw contact finger associated with a guide finger.

2. A contact assembly comprising a first guide finger and a second guide finger spaced from the first guide finger, a first jaw contact finger and a second jaw contact figure associated respectively with the first guide finger and the second guide finger, each of the first jaw contact and the second jaw contact formed with a jaw contact button each jaw contact button being disposed to float within an aperture formed in the respective first jaw contact and second jaw contact.

3. The contact assembly of claim 2, the first and second guide fingers being spaced apart having leading tips for guiding a blade therebetween.

4. The contact assembly of claim 3, the leading tips comprising arc sacrificial material.

5. The contact assembly of claim 2, the first and second jaw contact fingers being resilient, the first and second jaw contact fingers resiliently deflecting to accept a blade therebetween.

6. The contact assembly of claim 2, the first and second guide fingers supporting the respective first and second jaw contact fingers from collapsing.

7. The contact assembly of claim 2, the first or second guide finger comprising a bumper and a guide block that are adjustable to align and center the first and second guide fingers.

* * * * *